US009953580B2

(12) United States Patent
Kuang et al.

(10) Patent No.: US 9,953,580 B2
(45) Date of Patent: Apr. 24, 2018

(54) OLED GATE DRIVING CIRCUIT STRUCTURE

(71) Applicant: Shenzhen China Star Optoelectronics Technology Co., Ltd., Shenzhen (CN)

(72) Inventors: Jimu Kuang, Shenzhen (CN); Chihhao Wu, Shenzhen (CN); Houliang Hu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 266 days.

(21) Appl. No.: 14/890,911

(22) PCT Filed: Oct. 26, 2015

(86) PCT No.: PCT/CN2015/092796

§ 371 (c)(1),
(2) Date: Nov. 13, 2015

(87) PCT Pub. No.: WO2017/063225

PCT Pub. Date: Apr. 20, 2017

(65) Prior Publication Data

US 2017/0186376 A1 Jun. 29, 2017

(30) Foreign Application Priority Data

Oct. 12, 2015 (CN) ..... 2015 1 0658752

(51) Int. Cl.
*G09G 3/3266* (2016.01)
*G09G 3/3275* (2016.01)
*G09G 3/3225* (2016.01)

(52) U.S. Cl.
CPC ..... *G09G 3/3266* (2013.01); *G09G 3/3225* (2013.01); *G09G 3/3275* (2013.01);
(Continued)

(58) Field of Classification Search
CPC ... G09G 2310/0243; G09G 2310/0291; G09G 2310/08; G09G 3/3225; G09G 3/3266; G09G 3/3275
See application file for complete search history.

(56) References Cited

U.S. PATENT DOCUMENTS

2003/0146888 A1* 8/2003 Yamazaki ..... G09G 3/2022 345/82
2011/0090208 A1* 4/2011 Long ..... G09G 3/3233 345/211

(Continued)

FOREIGN PATENT DOCUMENTS

CN 104851391 A 8/2015
JP 2005189381 A 7/2005

*Primary Examiner* — Afroza Chowdhury
(74) *Attorney, Agent, or Firm* — Leong C. Lei

(57) ABSTRACT

The present invention provides an OLED gate driving circuit structure, comprising an OLED panel, a gate charge/discharge driving circuit, a logic process unit and a source driving circuit; the gate charge/discharge driving circuit is located at one side of the OLED panel, and the gate charge/discharge driving circuit comprises a plurality of output ends, and each output end is electrically coupled to the logic process unit with one signal line; the logic process unit is located inside the OLED panel, and the logic process unit receives a scan signal transmitted by the gate charge/discharge driving circuit through the signal line, and converts the scan signal into a discharge scan signal and a charge scan signal to be provided to the OLED panel; the source driving circuit is coupled to the OLED panel, and provides a data signal to the OLED panel, and only one gate driving integrated circuit is utilized in the structure for achieving the charge and discharge procedures of the gate driving circuit to save the hardware cost and to simplify the panel layout circuit and to make the frame of the panel narrower.

14 Claims, 6 Drawing Sheets

(52) U.S. Cl.
CPC ..... *G09G 2310/0243* (2013.01); *G09G 2310/0291* (2013.01); *G09G 2310/08* (2013.01)

(56) References Cited

U.S. PATENT DOCUMENTS

| | | | | |
|---|---|---|---|---|
| 2011/0273493 | A1* | 11/2011 | Yoshiga | G09G 3/3607 345/694 |
| 2015/0170578 | A1* | 6/2015 | Choi | G09G 3/3266 345/212 |
| 2015/0187261 | A1* | 7/2015 | Kim | G09G 3/3208 345/690 |
| 2015/0255012 | A1* | 9/2015 | Gu | H01L 27/3209 345/83 |

* cited by examiner

OLED GATE DRIVING CIRCUIT STRUCTURE

FIELD OF THE INVENTION

The present invention relates to a display technology field, and more particularly to an OLED gate driving circuit structure.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The present 3T1C pixel driving circuit employed for the OLED comprises a first thin film transistor, a second thin film transistor and a third thin film transistor. The first thin film transistor is a switch thin film transistor, employed for controlling the charge to the organic light emitting diode OLED; the second thin film transistor is a drive thin film transistor; the third thin film transistor is employed for controlling the discharge to the organic light emitting diode OLED. The duration of charge and discharge of sub frames (Subframe) is controlled by controlling the on-periods of the first thin film transistor and the third thin film transistor. With combination that the sense of the human eyes to the brightness is the integral principle of time, the digital voltage (i.e. two Gamma voltages) can be utilized for showing pictures of various gray scale brightnesses.

AS shown in FIG. 1, which is an OLED gate driving circuit structure according to prior art, comprising a gate charge driving circuit, a gate discharge driving circuit, a source driving circuit, and the gate charge driving circuit and the gate discharge driving circuit are respectively located at the left, right two sides of the OLED panel, and the gate charge driving circuit and the gate discharge driving circuit are achieved with different gate driving integrated circuits (IC). The advantage of the OLED gate driving circuit structure is that the well developed driving IC can be utilized.

However, the aforesaid OLED gate driving circuit structure requires two gate driving ICs and the hardware cost is high; meanwhile, the peripheral circuit of the OLED panel is added so that the frame of the panel becomes wider, which increases the technical requirements and the cost.

SUMMARY OF THE INVENTION

An objective of the present invention is to provide an OLED gate driving circuit structure, and only one gate driving integrated circuit is utilized in the structure for achieving the charge and discharge procedures of the gate driving circuit to save the hardware cost and to simplify the panel layout circuit and to make the frame of the panel narrower.

For realizing the aforesaid objectives, the present invention provides an OLED gate driving circuit structure, comprising an OLED panel, a gate charge/discharge driving circuit, a logic process unit and a source driving circuit; the gate charge/discharge driving circuit is located at one side of the OLED panel, and the gate charge/discharge driving circuit comprises a plurality of output ends, and each output end is electrically coupled to the logic process unit with one signal line;

the logic process unit is located inside the OLED panel, and the logic process unit receives a scan signal transmitted by the gate charge/discharge driving circuit through the signal line, and converts the scan signal into a discharge scan signal and a charge scan signal to be provided to the OLED panel;

the source driving circuit is coupled to the OLED panel, and provides a data signal to the OLED panel.

The OLED panel comprises a plurality of pixel driving circuits aligned in array, and each pixel driving circuit comprises a capacitor and three thin film transistors.

The logic process unit comprises:

a first input buffer, and an input end of the first input buffer is inputted with a clock signal, and an output end is electrically coupled to an input end of a global buffer;

the global buffer, and an output end of the global buffer is electrically coupled to a C end of a first D trigger and a C end of a second D trigger;

a second input buffer, and an input end of the second input buffer is inputted with a reset signal, and an output end is electrically coupled to an input end of a first look up table;

the first look up table, and an output end of the first look up table is electrically coupled to a CLR end of the first D trigger and a CLR end of the second D trigger;

a third input buffer, and an input end of the third input buffer is inputted with the scan signal, and an output end is electrically coupled to a D end of the first D trigger and, a first input end of a second look up table, a first input end of a third look up table and a second input end of a fourth look up table;

the first D trigger, and a CE end of the first D trigger is electrically coupled to a constant high voltage level, and a Q end is electrically coupled to a second input end of the second look up table;

the second look up table, and a third input end of the second look up table is electrically coupled to a second input end of the third look up table and a first input end of the fourth look up table, and an output end is electrically coupled to a D end of the second D trigger;

the second D trigger, and a CE end of the second D trigger is electrically coupled to a constant high voltage level, and a Q end is electrically coupled to a third input end of the second look up table, the second input end of the third look up table and the first input end of the fourth look up table;

the third look up table, and an output end of the third look up table is electrically coupled to an input end of a first output buffer;

the first output buffer, and an output end of the first output buffer outputs a first output signal;

the fourth look up table, and an output end of the fourth look up table is electrically coupled to an input end of a second output buffer;

the second output buffer, and an output end of the second output buffer outputs a second output signal.

A cycle of the first output signal and the second output signal is twice of the a cycle of the scan signal, and duty ratios are 1/4, and pulse positions are synchronous with pulses of the scan signals corresponding thereto;

the pulse positions of the first output signal and the second output signal do not overlap with each other.

One of the first output signal and the second output signal is employed to be the charge scan signal, and the other is employed to be the discharge scan signal.

All the first input buffer, the second input buffer, the third input buffer, the global buffer, the first output buffer and the second output buffer comprise: a first to a sixty-third transistors, a first to a thirty-second transistors and a first to fifth resistors;

a base of the first triode is electrically coupled to one end of the first resistor, and an emitter is electrically coupled to a negative electrode of the first diode, and a collector is electrically coupled to a base of the second triode; an emitter of the second triode is electrically coupled to one end of the third resistor and a base of the third triode, and a collector is electrically coupled to one end of the second resistor and a positive electrode of the second diode; an emitter of the third triode is electrically coupled to the other end of the third resistor and one end of the fifth resistor, and a collector is electrically coupled to a negative electrode of the second diode and a base of the fourth triode; an emitter of the fourth triode is electrically coupled to the other end of the fifth resistor and a base of the sixth triode, and a collector is electrically coupled to one end of the fourth resistor and a base of a fifth triode; an emitter of the fifth triode is electrically coupled to a positive electrode of the third diode, and a collector is electrically coupled to the other end of the fourth resistor; an emitter of the sixth triode is electrically coupled to one end of the fifth resistor, and a collector is electrically coupled to a negative electrode of the third diode; the other ends of the first, the second, the fourth resistors are electrically coupled to a power supply voltage; a positive electrode of the first diode is electrically coupled to the other end of the third resistor;

the negative electrode of the first diode and an emitter of the first triode are input ends, and the negative electrode of the third diode and an emitter of the sixth triode are output ends;

voltage levels of input signals of the input ends and voltage levels of output signals of the output ends are the same.

Both the first D trigger and the second D trigger comprise a first to a sixth NAND gates;

a first input end of the first NAND gate is employed to be a CLR end of a D trigger, and a second end is electrically coupled to a first input end of the third NAND gate, and an output end is electrically coupled to a first input end of the second NAND gate; a second input end of the second NAND gate is electrically coupled to a second input end of the third NAND gate to commonly be a C end of the D trigger, and a third input end is electrically coupled to a first input end of the fourth NAND gate, and an output end is electrically coupled to a first input end of the fifth NAND gate; a third input end of the third NAND gate is electrically coupled to an output end of the fourth NAND gate, and an output end is electrically coupled to a second input end of the sixth NAND gate; a second input end of the fourth NAND gate is employed to be a D end of the D trigger; a second input end of the fifth NAND gate is electrically coupled to an output end of the sixth NAND gate; a first input end of the sixth NAND gate is electrically coupled to an output end of the fifth NAND gate and to be an Q end of the D trigger.

The second look up table comprises: a first, a second inverters and a first, a second AND gates;

an input end of the first inverter is employed to be a first input end of the second look up table, and an output end is electrically coupled to a first input end of the first AND gate; an input end of the second inverter is employed to be a third input end of the second look up table, and an output end is electrically coupled to a second input end of the second AND gate; a second input end of the first AND gate is employed to be a second input end of the second look up table, and an output end is electrically coupled to a first input end of the second AND gate; an output end of the second AND gate is employed to be an output end of the second look up table.

The third look up table comprises: a third inverter and a third AND gate;

an input end of the third inverter is employed to be a second input end of the third look up table, and an output end is electrically coupled to a second input end of the third AND gate; a first input end of the third AND gate is employed to be a first input end of the third look up table, and an output end is employed to be an output end of the third look up table.

The fourth look up table comprises a fourth AND gate;

a first input end of the fourth AND gate is employed to be a first input end of the fourth look up table, and a second input end is employed to be a second input end of the fourth look up table, and an output end is employed to be an output end of the fourth look up table.

The present invention further provides an OLED gate driving circuit structure, comprising an OLED panel, a gate charge/discharge driving circuit, a logic process unit and a source driving circuit;

the gate charge/discharge driving circuit is located at one side of the OLED panel, and the gate charge/discharge driving circuit comprises a plurality of output ends, and each output end is electrically coupled to the logic process unit with one signal line;

the logic process unit is located inside the OLED panel, and the logic process unit receives a scan signal transmitted by the gate charge/discharge driving circuit through the signal line, and converts the scan signal into a discharge scan signal and a charge scan signal to be provided to the OLED panel;

the source driving circuit is coupled to the OLED panel, and provides a data signal to the OLED panel;

wherein the OLED panel comprises a plurality of pixel driving circuits aligned in array, and each pixel driving circuit comprises a capacitor and three thin film transistors;

wherein the logic process unit comprises:

a first input buffer, and an input end of the first input buffer is inputted with a clock signal, and an output end is electrically coupled to an input end of a global buffer;

the global buffer, and an output end of the global buffer is electrically coupled to a C end of a first D trigger and a C end of a second D trigger;

a second input buffer, and an input end of the second input buffer is inputted with a reset signal, and an output end is electrically coupled to an input end of a first look up table;

the first look up table, and an output end of the first look up table is electrically coupled to a CLR end of the first D trigger and a CLR end of the second D trigger;

a third input buffer, and an input end of the third input buffer is inputted with the scan signal, and an output end is electrically coupled to a D end of the first D trigger and, a first input end of a second look up table, a first input end of a third look up table and a second input end of a fourth look up table;

the first D trigger, and a CE end of the first D trigger is electrically coupled to a constant high voltage level, and a Q end is electrically coupled to a second input end of the second look up table;

the second look up table, and a third input end of the second look up table is electrically coupled to a second input end of the third look up table and a first input end of the fourth look up table, and an output end is electrically coupled to a D end of the second D trigger;

the second D trigger, and a CE end of the second D trigger is electrically coupled to a constant high voltage level, and a Q end is electrically coupled to a third input end of the second look up table, the second input end of the third look up table and the first input end of the fourth look up table;

the third look up table, and an output end of the third look up table is electrically coupled to an input end of a first output buffer;

the first output buffer, and an output end of the first output buffer outputs a first output signal;

the fourth look up table, and an output end of the fourth look up table is electrically coupled to an input end of a second output buffer;

the second output buffer, and an output end of the second output buffer outputs a second output signal;

wherein a cycle of the first output signal and the second output signal is twice of the a cycle of the scan signal, and duty ratios are ¼, and pulse positions are synchronous with pulses of the scan signals corresponding thereto;

the pulse positions of the first output signal and the second output signal do not overlap with each other;

wherein one of the first output signal and the second output signal is employed to be the charge scan signal, and the other is employed to be the discharge scan signal.

The benefits of the present invention are: in the OLED gate driving circuit structure provided by the present invention, by one gate charge/discharge driving circuit located at one side of the OLED panel to cooperate with the logic process unit electrically coupled to the gate charge/discharge driving circuit, and by the logic process unit to convert the scan signal into a discharge scan signal and a charge scan signal to be provided to the OLED panel, only one gate driving integrated circuit (i.e. the gate charge/discharge driving circuit) is utilized for achieving the charge and discharge procedures of the gate driving circuit. In comparison with prior art, one gate driving integrated circuit is eliminated to save the hardware cost and to simplify the panel layout circuit and to make the frame of the panel narrower.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
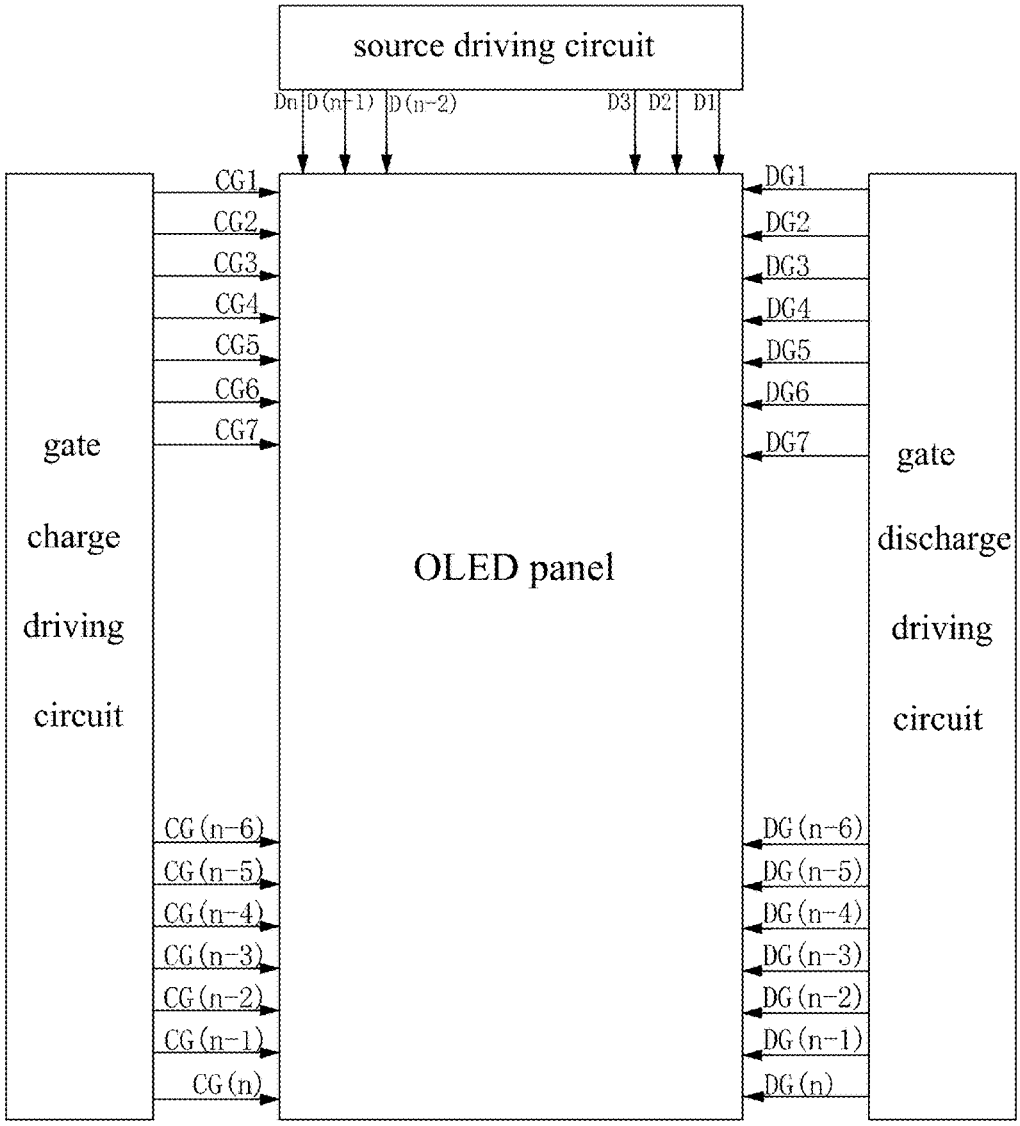
Fig. 1(Prior Art)
FIG. 1 is an OLED gate driving circuit structure according to prior art.
Figure 2:
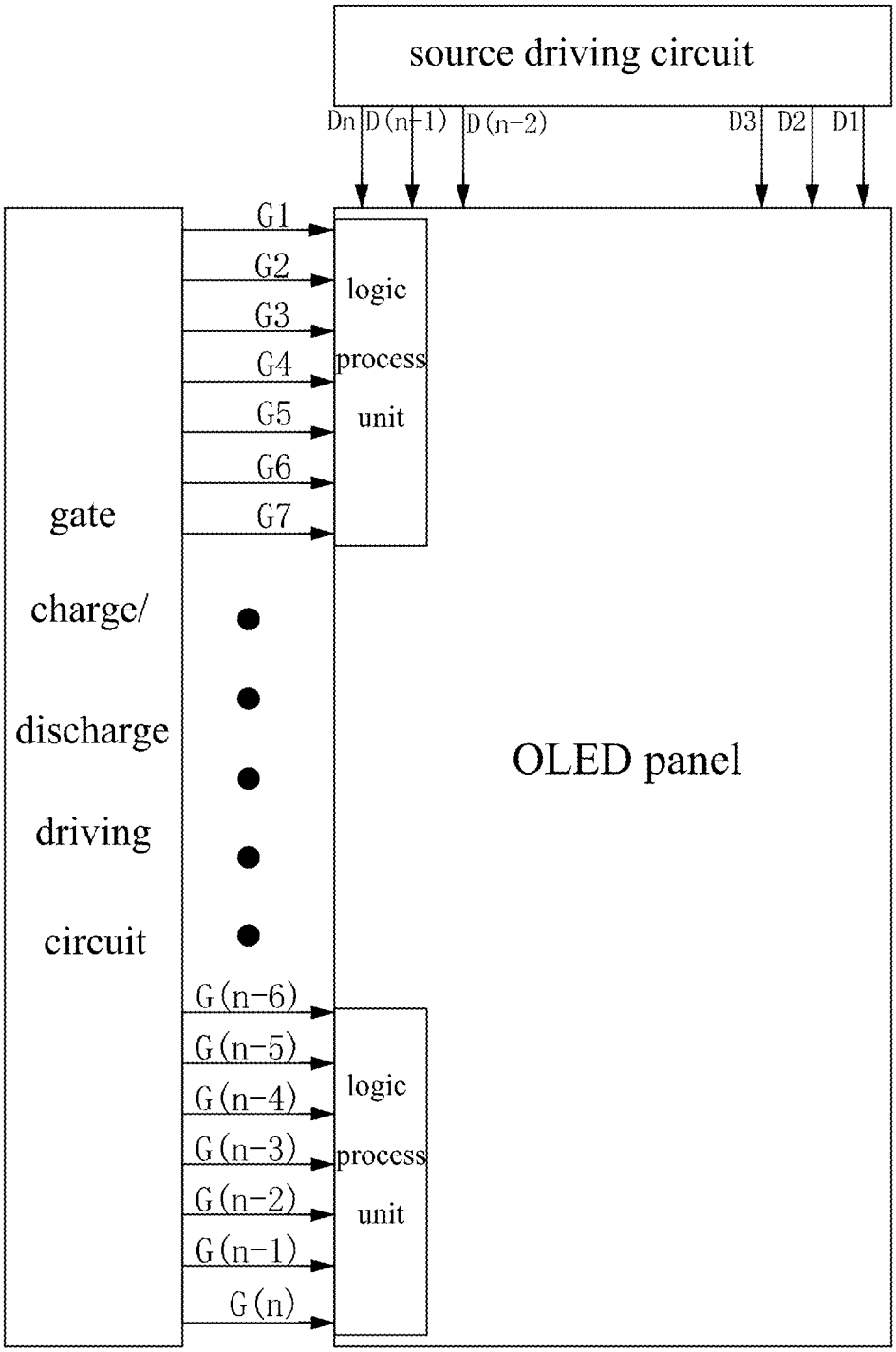
FIG. 2 is an OLED gate driving circuit structure according to the present invention.

Please refer to FIG. 2. The present invention provides an OLED gate driving circuit structure, comprising: an OLED panel, a gate charge/discharge driving circuit, a logic process unit and a source driving circuit; the gate charge/discharge driving circuit is located at one side of the OLED panel, and the gate charge/discharge driving circuit comprises a plurality of output ends, and each output end is electrically coupled to the logic process unit with one signal line; the logic process unit is located inside the OLED panel, and the logic process unit receives a scan signal transmitted by the gate charge/discharge driving circuit through the signal line, and converts the scan signal into a discharge scan signal and a charge scan signal to be provided to the OLED panel; the source driving circuit is coupled to the OLED panel, and provides a data signal to the OLED panel.

Specifically, the OLED gate driving circuit structure is constructed by a gate driving IC. The OLED display panel comprises a plurality of pixel driving circuits aligned in array, and each pixel driving circuit comprises a capacitor and three thin film transistors. Furthermore, the pixel driving circuit comprises a first thin film transistor, a second thin film transistor, a third thin film transistor and a capacitor. The first transistor is a charge thin film transistor, employed to control the charge to the organic light emitting diode OLED, and provides the charge scan signal converted by the logic process unit to the first thin film transistor for controlling the charge of the OLED panel; the second thin film transistor is a drive thin film transistor; the third thin film transistor is a discharge thin film transistor, which provides the discharge scan signal converted by the logic process unit to the third thin film transistor for controlling the discharge of the OLED panel.

Figure 3:
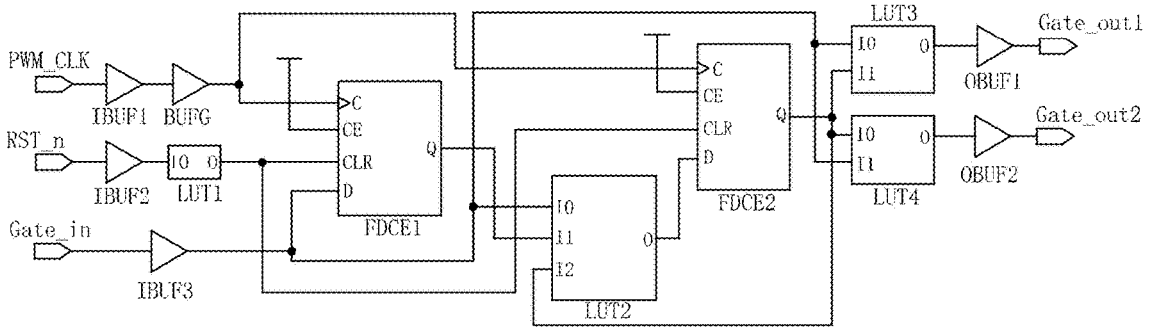
FIG. 3 is a circuit diagram of a logic process unit in the OLED gate driving circuit structure according to the present invention.

Please refer to FIG. 3. The logic process unit comprises: a first input buffer IBUF1, and an input end of the first input buffer IBUF1 is inputted with a clock signal PWM_CLK, and an output end is electrically coupled to an input end of a global buffer BUFG; the global buffer BUFG, and an output end of the global buffer BUFG is electrically coupled to a C end of a first D trigger FDCE1 and a C end of a second D trigger FDCE2; a second input buffer IBUF2, and an input end of the second input buffer IBUF2 is inputted with a reset signal RST_n, and an output end is electrically coupled to an input end of a first look up table LUT1; the first look up table LUT1, and an output end of the first look up table LUT1 is electrically coupled to a CLR end of the first D trigger FDCE1 and a CLR end of the second D trigger FDCE2; a third input buffer IBUF3, and an input end of the third input buffer IBUF3 is inputted with the scan signal Gate_in, and an output end is electrically coupled to a D end of the first D trigger Gate_in and, a first input end of a second look up table LUT2, a first input end of a third look up table LUT3 and a second input end of a fourth look up table LUT4; the first D trigger FDCE1, and a CE end of the first D trigger FDCE1 is electrically coupled to a constant high voltage level, and a Q end is electrically coupled to a second input end of the second look up table LUT2; the second look up table LUT2, and a third input end of the second look up table LUT2 is electrically coupled to a second input end of the third look up table LUT3 and a first input end of the fourth look up table LUT4, and an output end is electrically coupled to a D end of the second D trigger FDCE2; the second D trigger FDCE2, and a CE end of the second D trigger FDCE2 is electrically coupled to a constant high voltage level, and a Q end is electrically coupled to a third input end of the second look up table LUT2, the second input end of the third look up table LUT3 and the first input end of the fourth look up table LUT4; the third look up table LUT3, and an output end of the third look up table LUT3 is electrically coupled to an input end of a first output buffer OBUF1; the first output buffer OBUF1, and an output end of the first output buffer OBUF1 outputs a first output signal Gate_out1; the fourth look up table LUT4, and an output end of the fourth look up table LUT4 is electrically coupled to an input end of a second output buffer OBUF2; the second output buffer OBUF2, and an output end of the second output buffer OBUF2 outputs a second output signal Gate_out2.

Figure 4:
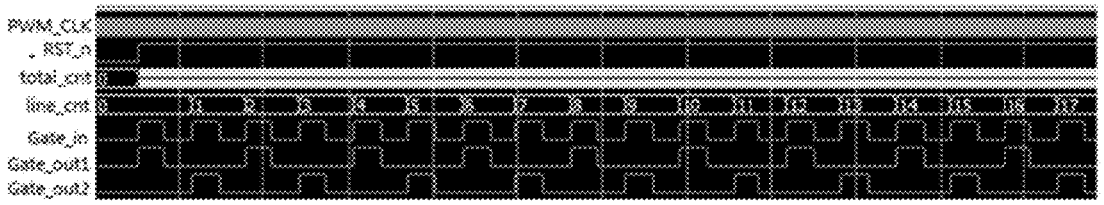
FIG. 4 is an emulational waveform diagram of the circuit shown in FIG. 3.

Furthermore, referring to FIG. 4, the logic process unit inputs the clock signal PWM_CLK, the reset signal RST_n and the scan signal Gate_in, and correspondingly outputs the second output signal Gate_out2 and the first output signal Gate_out1 according to the designed sequence. A cycle of the first output signal Gate_out1 and the second output signal Gate_out2 which are outputted after the conversion of the aforesaid logic process unit is twice of the a cycle of the scan signal Gate_in, and duty ratios are ¼, and pulse positions are synchronous with pulses of the scan signals Gate_in corresponding thereto; the pulse positions of the first output signal Gate_out1 and the second output signal Gate_out2 do not overlap with each other. One of the first output signal Gate_out1 and the second output signal Gate_out2 is employed to be the charge scan signal, and the other is employed to be the discharge scan signal.

Figure 5:
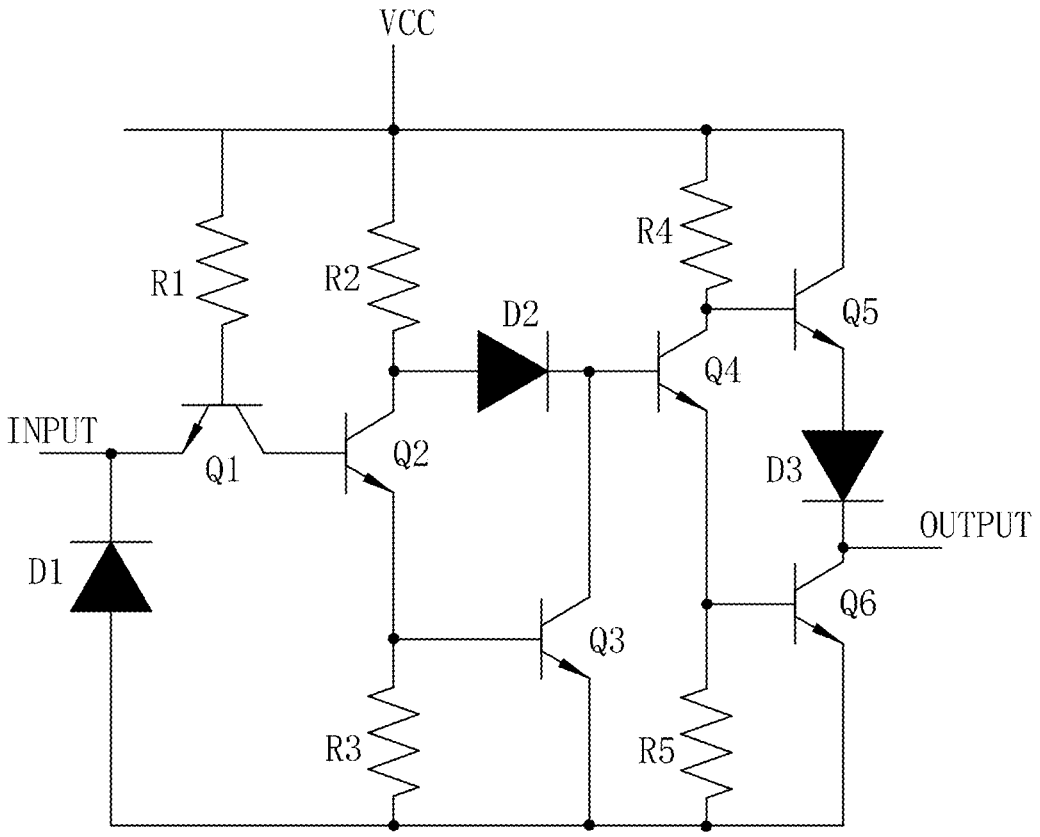
FIG. 5 is a circuit diagram of respective buffers in the logic process unit shown in FIG. 3.

Specifically, referring to FIG. 5 with combination of FIG. 3. All the respective buffers in the circuit shown in FIG. 3 comprising a first input buffer IBUF1, a second input buffer IBUF2, a third input buffer IBUF3, a global buffer BUFG, a first output buffer OBUF1 and a second output buffer OBUF2 has the structure shown in FIG. 5. As shown in FIG. 5, the buffer comprises: a first npn-type bipolar junction transistor to a sixth npn-type bipolar junction transistor Q1-Q6, a first to a third diodes D1-D3 and a first to fifth resistors R1-R5;

a base of the first npn-type bipolar junction transistor Q1 is electrically coupled to one end of the first resistor R1, and an emitter is electrically coupled to a negative electrode of the first diode D1, and a collector is electrically coupled to a base of the second npn-type bipolar junction transistor Q2; an emitter of the second npn-type bipolar junction transistor Q2 is electrically coupled to one end of the third resistor R3 and a base of the third npn-type bipolar junction transistor Q3, and a collector is electrically coupled to one end of the second resistor R2 and a positive electrode of the second diode D2; an emitter of the third npn-type bipolar junction transistor Q3 is electrically coupled to the other end of the third resistor R3 and one end of the fifth resistor R5, and a collector is electrically coupled to a negative electrode of the second diode D2 and a base of the fourth npn-type bipolar junction transistor Q4; an emitter of the fourth npn-type bipolar junction transistor Q4 is electrically coupled to the other end of the fifth resistor R5 and a base of the sixth npn-type bipolar junction transistor Q6, and a collector is electrically coupled to one end of the fourth resistor R4 and a base of a fifth npn-type bipolar junction transistor Q5; an emitter of the fifth npn-type bipolar junction transistor Q5 is electrically coupled to a positive electrode of the third diode D3, and a collector is electrically coupled to the other end of the fourth resistor R4; an emitter of the sixth npn-type bipolar junction transistor Q6 is electrically coupled to one end of the fifth resistor R5, and a collector is electrically coupled to a negative electrode of the third diode D3; the other ends of the first, the second, the fourth resistors R1, R2, R4 are electrically coupled to a power supply voltage VCC; a positive electrode of the first diode D1 is electrically coupled to the other end of the third resistor R3;

the negative electrode of the first diode D1 and an emitter of the first npn-type bipolar junction transistor Q1 are input ends INPUT, and the negative electrode of the third diode D3 and an emitter of the sixth npn-type bipolar junction transistor Q6 are output ends OUTPUT;

voltage levels of input signals of the input ends INPUT and voltage levels of output signals of the output ends OUTPUT are the same.

Particularly, the NMOS transistor can be utilized to replace the first to the sixth npn-type bipolar junction transistor Q1-Q6 in the buffer shown in FIG. 5. The buffer possesses properties as following. When the input signal at the input end INPUT is high voltage level, the output signal of the output end OUTPUT is high voltage level. When the input signal at the input end INPUT is low voltage level, the output signal of the output end OUTPUT is low voltage level.

Figure 6:
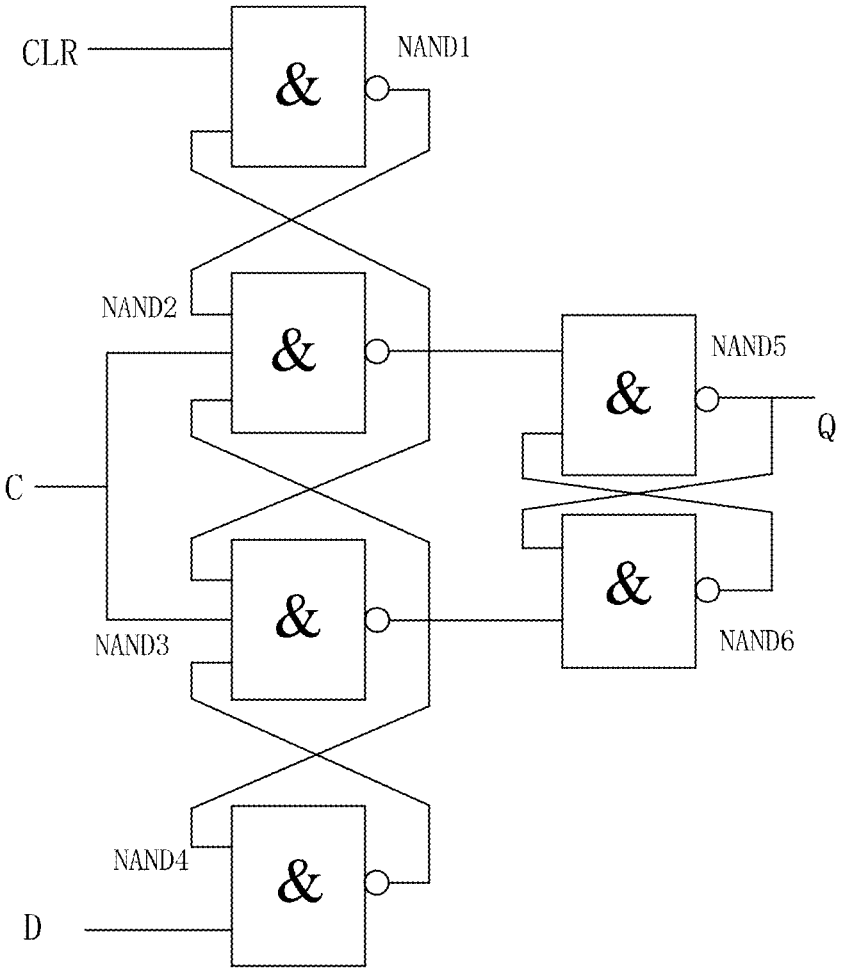
FIG. 6 is a circuit diagram of an D trigger in the logic process unit shown in FIG. 3.

Specifically, referring to FIG. 6 with combination of FIG. 3. All the respective D triggers in the circuit shown in FIG. 3 comprising a first D trigger FDCE1 and a second D trigger FDCE2 have the structure shown in FIG. 6, which comprises a first to a sixth NAND gates NADN1-NAND6;

a first input end of the first NAND gate NAND1 is employed to be a CLR end of a D trigger, and a second end is electrically coupled to a first input end of the third NAND gate NAND3, and an output end is electrically coupled to a first input end of the second NAND gate NAND2; a second input end of the second NAND gate NAND2 is electrically coupled to a second input end of the third NAND gate NAND3 to commonly be a C end of the D trigger, and a third input end is electrically coupled to a first input end of the fourth NAND gate NAND4, and an output end is electrically coupled to a first input end of the fifth NAND gate NAND5; a third input end of the third NAND gate NAND3 is electrically coupled to an output end of the fourth NAND gate NAND4, and an output end is electrically coupled to a second input end of the sixth NAND gate NAND6; a second input end of the fourth NAND gate NAND4 is employed to be a D end of the D trigger; a second input end of the fifth NAND gate NAND5 is electrically coupled to an output end of the sixth NAND gate NAND6; a first input end of the sixth NAND gate NAND6 is electrically coupled to an output end of the fifth NAND gate NAND5 and to be an Q end of the D trigger.

Figure 7:
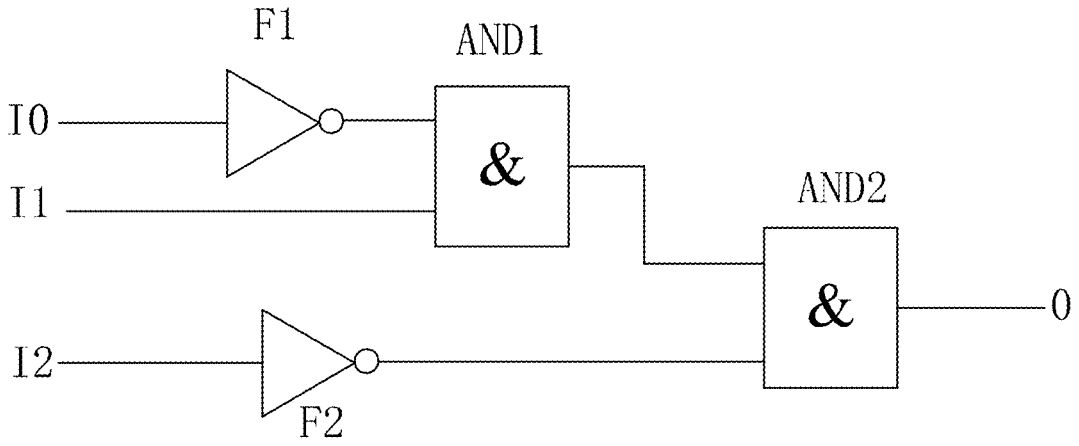
FIG. 7 is a circuit diagram of a second look up table in the logic process unit shown in FIG. 3.

Specifically, referring to FIG. 7, the second look up table LUT2 comprises: a first, a second inverters F1, F2 and a first, a second AND gates AND1, AND2; an input end of the first inverter F1 is employed to be a first input end (i.e. I0 end shown in FIG. 7) of the second look up table LUT2, and an output end is electrically coupled to a first input end of the first AND gate AND1; an input end of the second inverter F2 is employed to be a third input end (i.e. I2 end shown in FIG. 7) of the second look up table LUT2, and an output end is electrically coupled to a second input end of the second AND gate AND2; a second input end of the first AND gate AND1 is employed to be a second input end (i.e. I1 end shown in FIG. 7) of the second look up table LUT2, and an output end is electrically coupled to a first input end of the second AND gate AND2; an output end of the second AND gate AND2 is employed to be an output end of the second look up table LUT2. Then, the output signal of the second look up table LUT2 is 1 only when the input signals I0=0, I1=1, I2=0. The output signal is 0 in the rest conditions.

Figure 8:
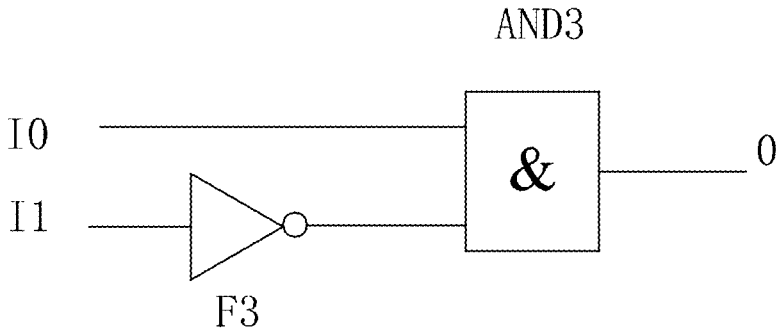
FIG. 8 is a circuit diagram of a third look up table in the logic process unit shown in FIG. 3.

Please refer to FIG. 8. The third look up table LUT3 comprises: a third inverter F3 and a third AND gate AND3; an input end of the third inverter F3 is employed to be a second input end (i.e. I1 end shown in FIG. 8) of the third look up table LUT3, and an output end is electrically coupled to a second input end of the third AND gate AND3; a first input end of the third AND gate AND3 is employed to be a first input end (i.e. I0 end shown in FIG. 8) of the third look up table LUT3, and an output end is employed to be an output end of the third look up table LUT3. Then, the output signal of the third look up table LUT3 is 1 only when the input signals I0=1, I1=0. The output signal is 0 in the rest conditions.

Figure 9:
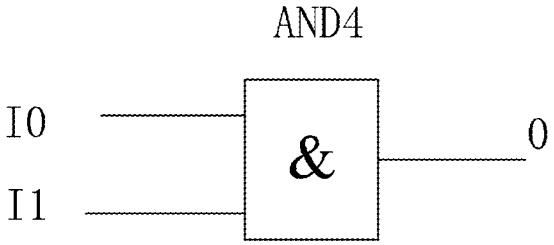
FIG. 9 is a circuit diagram of a fourth look up table in the logic process unit shown in FIG. 3.

Please refer to FIG. 9. The fourth look up table LUT4 comprises a fourth AND gate AND4; a first input end of the fourth AND gate AND4 is employed to be a first input end (i.e. I0 end shown in FIG. 9) of the fourth look up table LUT4, and a second input end is employed to be a second input end of the fourth look up table LUT4, and an output end is employed to be an output end (i.e. I1 end shown in FIG. 9) of the fourth look up table LUT4. Then, the output signal of the fourth look up table LUT4 is 1 only when the input signals I0=1, I1=1. The output signal is 0 in the rest conditions.

In conclusion, in the OLED gate driving circuit structure provided by the present invention, by one gate charge/discharge driving circuit located at one side of the OLED panel to cooperate with the logic process unit electrically coupled to the gate charge/discharge driving circuit, and by the logic process unit to convert the scan signal into a discharge scan signal and a charge scan signal to be provided to the OLED panel, only one gate driving integrated circuit (i.e. the gate charge/discharge driving circuit) is utilized for achieving the charge and discharge procedures of the gate driving circuit. In comparison with prior art, one gate driving integrated circuit is eliminated to save the hardware cost and to simplify the panel layout circuit and to make the frame of the panel narrower.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An OLED gate driving circuit structure, comprising an OLED panel, a gate charge/discharge driving circuit, a logic process unit and a source driving circuit;

the gate charge/discharge driving circuit is located at one side of the OLED panel, and the gate charge/discharge driving circuit comprises a plurality of output ends, and each output end is electrically coupled to the logic process unit with one signal line;

the logic process unit is located inside the OLED panel, and the logic process unit receives a scan signal transmitted by the gate charge/discharge driving circuit through the signal line, and converts the scan signal into a discharge scan signal and a charge scan signal to be provided to the OLED panel;

the source driving circuit is coupled to the OLED panel, and provides a data signal to the OLED panel;

wherein the logic process unit comprises:

a first input buffer, and an input end of the first input buffer is inputted with a clock signal, and an output end is electrically coupled to an input end of a global buffer;

the global buffer, and an output end of the global buffer is electrically coupled to a C end of a first D trigger and a C end of a second D trigger;

a second input buffer, and an input end of the second input buffer is inputted with a reset signal, and an output end is electrically coupled to an input end of a circuit containing first look up table;

the circuit containing first look up table, and an output end of the circuit containing first look up table is electrically coupled to a CLR end of the first D trigger and a CLR end of the second D trigger;

a third input buffer, and an input end of the third input buffer is inputted with the scan signal, and an output end is electrically coupled to a D end of the first D trigger and, a first input end of a circuit containing second look up table, a first input end of a circuit containing third look up table and a second input end of a circuit containing fourth look up table;

the first D trigger, and a CE end of the first D trigger is electrically coupled to a constant high voltage level, and a Q end is electrically coupled to a second input end of the circuit containing second look up table;

the circuit containing second look up table, and a third input end of the circuit containing second look up table is electrically coupled to a second input end of the circuit containing third look up table and a first input end of the circuit containing fourth look up table, and an output end is electrically coupled to a D end of the second D trigger;

the second D trigger, and a CE end of the second D trigger is electrically coupled to a constant high voltage level, and a Q end is electrically coupled to a third input end of the circuit containing second look up table, the second input end of the circuit containing third look up table and the first input end of the circuit containing fourth look up table;

the circuit containing third look up table, and an output end of the circuit containing third look up table is electrically coupled to an input end of a first output buffer;

the first output buffer, and an output end of the first output buffer outputs a first output signal;

the circuit containing fourth look up table, and an output end of the circuit containing fourth look up table is electrically coupled to an input end of a second output buffer;

the second output buffer, and an output end of the second output buffer outputs a second output signal.

2. The OLED gate driving circuit structure according to claim 1, wherein a cycle of the first output signal and the second output signal is twice of the a cycle of the scan signal, and duty ratios are 1/4, and pulse positions are synchronous with pulses of the scan signals corresponding thereto;

the pulse positions of the first output signal and the second output signal do not overlap with each other.

3. The OLED gate driving circuit structure according to claim 1, wherein one of the first output signal and the second output signal is employed to be the charge scan signal, and the other is employed to be the discharge scan signal.

4. The OLED gate driving circuit structure according to claim 1, wherein each of the first input buffer, the second input buffer, the third input buffer, the global buffer, the first output buffer and the second output buffer comprise: a first npn-type bipolar junction transistor to a sixth npn-type bipolar junction transistor, a first to a third diodes and a first to fifth resistors;

a base of the first npn-type bipolar junction transistor is electrically coupled to one end of the first resistor, and an emitter is electrically coupled to a negative electrode of the first diode, and a collector is electrically coupled to a base of the second npn-type bipolar junction transistor; an emitter of the second npn-type bipolar junction transistor is electrically coupled to one end of the third resistor and a base of the third npn-type bipolar junction transistor, and a collector is electrically coupled to one end of the second resistor and a positive electrode of the second diode; an emitter of the third npn-type bipolar junction transistor is electrically coupled to the other end of the third resistor and one end of the fifth resistor, and a collector is electrically coupled to a negative electrode of the second diode and a base of the fourth npn-type bipolar junction transistor; an emitter of the fourth npn-type bipolar junction transistor is electrically coupled to the other end of the fifth resistor and a base of the sixth npn-type bipolar junction transistor, and a collector is electrically coupled to one end of the fourth resistor and a base of a fifth npn-type bipolar junction transistor; an emitter of the fifth npn-type bipolar junction transistor is electrically coupled to a positive electrode of the third diode, and a collector is electrically coupled to the other end of the fourth resistor; an emitter of the sixth npn-type bipolar junction transistor is electrically coupled to one end of the fifth resistor, and a collector is electrically coupled to a negative electrode of the third diode; the other ends of the first, the second, the fourth resistors are electrically coupled to a power supply voltage; a positive electrode of the first diode is electrically coupled to the other end of the third resistor;

the negative electrode of the first diode and an emitter of the first npn-type bipolar junction transistor are input ends, and the negative electrode of the third diode and an emitter of the sixth npn-type bipolar junction transistor are output ends;

voltage levels of input signals of the input ends and voltage levels of output signals of the output ends are the same.

5. The OLED gate driving circuit structure according to claim 1, wherein both the first D trigger and the second D trigger comprise a first to a sixth NAND gates;

a first input end of the first NAND gate is employed to be a CLR end of a D trigger, and a second end is electrically coupled to a first input end of the third NAND gate, and an output end is electrically coupled to a first input end of the second NAND gate; a second input end of the second NAND gate is electrically coupled to a second input end of the third NAND gate to commonly be a C end of the D trigger, and a third input end is electrically coupled to a first input end of the fourth NAND gate, and an output end is electrically coupled to a first input end of the fifth NAND gate; a third input end of the third NAND gate is electrically coupled to an output end of the fourth NAND gate, and an output end is electrically coupled to a second input end of the sixth NAND gate; a second input end of the fourth NAND gate is employed to be a D end of the D trigger; a second input end of the fifth NAND gate is electrically coupled to an output end of the sixth NAND gate; a first input end of the sixth NAND gate is electrically coupled to an output end of the fifth NAND gate and to be an Q end of the D trigger.

6. The OLED gate driving circuit structure according to claim 1, wherein the circuit containing second look up table comprises: a first, a second inverters and a first, a second AND gates;

an input end of the first inverter is employed to be a first input end of the circuit containing second look up table, and an output end is electrically coupled to a first input end of the first AND gate; an input end of the second inverter is employed to be a third input end of the circuit containing second look up table, and an output end is electrically coupled to a second input end of the second AND gate; a second input end of the first AND gate is employed to be a second input end of the circuit containing second look up table, and an output end is electrically coupled to a first input end of the second AND gate; an output end of the second AND gate is employed to be an output end of the circuit containing second look up table.

7. The OLED gate driving circuit structure according to claim 1, wherein the circuit containing third look up table comprises: a third inverter and a third AND gate;

an input end of the third inverter is employed to be a second input end of the circuit containing third look up table, and an output end is electrically coupled to a second input end of the third AND gate; a first input end of the third AND gate is employed to be a first input end of the circuit containing third look up table, and an output end is employed to be an output end of the circuit containing third look up table.

8. The OLED gate driving circuit structure according to claim 1, wherein the circuit containing fourth look up table comprises a fourth AND gate;

a first input end of the fourth AND gate is employed to be a first input end of the circuit containing fourth look up table, and a second input end is employed to be a second input end of the circuit containing fourth look up table, and an output end is employed to be an output end of the circuit containing fourth look up table.

9. An OLED gate driving circuit structure, comprising an OLED panel, a gate charge/discharge driving circuit, a logic process unit and a source driving circuit;

the gate charge/discharge driving circuit is located at one side of the OLED panel, and the gate charge/discharge driving circuit comprises a plurality of output ends, and each output end is electrically coupled to the logic process unit with one signal line;

the logic process unit is located inside the OLED panel, and the logic process unit receives a scan signal transmitted by the gate charge/discharge driving circuit through the signal line, and converts the scan signal into a discharge scan signal and a charge scan signal to be provided to the OLED panel;

the source driving circuit is coupled to the OLED panel, and provides a data signal to the OLED panel;

wherein the logic process unit comprises:

a first input buffer, and an input end of the first input buffer is inputted with a clock signal, and an output end is electrically coupled to an input end of a global buffer;

the global buffer, and an output end of the global buffer is electrically coupled to a C end of a first D trigger and a C end of a second D trigger;

a second input buffer, and an input end of the second input buffer is inputted with a reset signal, and an output end is electrically coupled to an input end of a circuit containing first look up table;

the circuit containing first look up table, and an output end of the circuit containing first look up table is electrically coupled to a CLR end of the first D trigger and a CLR end of the second D trigger;

a third input buffer, and an input end of the third input buffer is inputted with the scan signal, and an output end is electrically coupled to a D end of the first D trigger and, a first input end of a circuit containing second look up table, a first input end of a circuit containing third look up table and a second input end of a circuit containing fourth look up table;

the first D trigger, and a CE end of the first D trigger is electrically coupled to a constant high voltage level, and a Q end is electrically coupled to a second input end of the circuit containing second look up table;

the circuit containing second look up table, and a third input end of the circuit containing second look up table is electrically coupled to a second input end of the circuit containing third look up table and a first input end of the circuit containing fourth look up table, and an output end is electrically coupled to a D end of the second D trigger;

the second D trigger, and a CE end of the second D trigger is electrically coupled to a constant high voltage level, and a Q end is electrically coupled to a third input end of the circuit containing second look up table, the second input end of the circuit containing third look up table and the first input end of the circuit containing fourth look up table;

the circuit containing third look up table, and an output end of the circuit containing third look up table is electrically coupled to an input end of a first output buffer;

the first output buffer, and an output end of the first output buffer outputs a first output signal;

the circuit containing fourth look up table, and an output end of the circuit containing fourth look up table is electrically coupled to an input end of a second output buffer;

the second output buffer, and an output end of the second output buffer outputs a second output signal;

wherein a cycle of the first output signal and the second output signal is twice of the a cycle of the scan signal, and duty ratios are 1/4, and pulse positions are synchronous with pulses of the scan signals corresponding thereto;

the pulse positions of the first output signal and the second output signal do not overlap with each other;

wherein one of the first output signal and the second output signal is employed to be the charge scan signal, and the other is employed to be the discharge scan signal.

10. The OLED gate driving circuit structure according to claim 9, wherein all the first input buffer, the second input buffer, the third input buffer, the global buffer, the first output buffer and the second output buffer comprise: a first npn-type bipolar junction transistor to a sixth npn-type bipolar junction transistor, a first to a third diodes and a first to fifth resistors;

a base of the first npn-type bipolar junction transistor is electrically coupled to one end of the first resistor, and an emitter is electrically coupled to a negative electrode of the first diode, and a collector is electrically coupled to a base of the second npn-type bipolar junction transistor; an emitter of the second is electrically coupled to one end of the third resistor and a base of the third npn-type bipolar junction transistor, and a collector is electrically coupled to one end of the second resistor and a positive electrode of the second diode; an emitter of the third npn-type bipolar junction transistor is electrically coupled to the other end of the third resistor and one end of the fifth resistor, and a collector is electrically coupled to a negative electrode of the second diode and a base of the fourth npn-type bipolar junction transistor; an emitter of the fourth npn-type bipolar junction transistor is electrically coupled to the other end of the fifth resistor and a base of the sixth npn-type bipolar junction transistor, and a collector is electrically coupled to one end of the fourth resistor and a base of a fifth npn-type bipolar junction transistor; an emitter of the fifth npn-type bipolar junction transistor is electrically coupled to a positive electrode of the third diode, and a collector is electrically coupled to the other end of the fourth resistor; an emitter of the sixth npn-type bipolar junction transistor is electrically coupled to one end of the fifth resistor, and a collector is electrically coupled to a negative electrode of the third diode; the other ends of the first, the second, the fourth resistors are electrically coupled to a power supply voltage; a positive electrode of the first diode is electrically coupled to the other end of the third resistor;

the negative electrode of the first diode and an emitter of the first npn-type bipolar junction transistor are input ends, and the negative electrode of the third diode and an emitter of the sixth npn-type bipolar junction transistor are output ends;

voltage levels of input signals of the input ends and voltage levels of output signals of the output ends are the same.

11. The OLED gate driving circuit structure according to claim 9, wherein both the first D trigger and the second D trigger comprise a first to a sixth NAND gates;

a first input end of the first NAND gate is employed to be a CLR end of a D trigger, and a second end is electrically coupled to a first input end of the third NAND gate, and an output end is electrically coupled to a first input end of the second NAND gate; a second input end of the second NAND gate is electrically coupled to a second input end of the third NAND gate to commonly be a C end of the D trigger, and a third input end is electrically coupled to a first input end of the fourth NAND gate, and an output end is electrically coupled to a first input end of the fifth NAND gate; a third input end of the third NAND gate is electrically coupled to an output end of the fourth NAND gate, and an output end is electrically coupled to a second input end of the sixth NAND gate; a second input end of the fourth NAND gate is employed to be a D end of the D trigger; a second input end of the fifth NAND gate is electrically coupled to an output end of the sixth NAND gate; a first input end of the sixth NAND gate is electrically coupled to an output end of the fifth NAND gate and to be an Q end of the D trigger.

12. The OLED gate driving circuit structure according to claim 9, wherein the circuit containing second look up table comprises:

a first, a second inverters and a first, a second AND gates;

an input end of the first inverter is employed to be a first input end of the circuit containing second look up table, and an output end is electrically coupled to a first input end of the first AND gate; an input end of the second inverter is employed to be a third input end of the circuit containing second look up table, and an output end is electrically coupled to a second input end of the second AND gate; a second input end of the first AND gate is employed to be a second input end of the circuit containing second look up table, and an output end is electrically coupled to a first input end of the second AND gate; an output end of the second AND gate is employed to be an output end of the circuit containing second look up table.

13. The OLED gate driving circuit structure according to claim 9, wherein the circuit containing third look up table comprises: a third inverter and a third AND gate;

an input end of the third inverter is employed to be a second input end of the circuit containing third look up table, and an output end is electrically coupled to a second input end of the third AND gate; a first input end of the third AND gate is employed to be a first input end of the circuit containing third look up table, and an output end is employed to be an output end of the circuit containing third look up table.

14. The OLED gate driving circuit structure according to claim 9, wherein the circuit containing fourth look up table comprises a fourth AND gate;

a first input end of the fourth AND gate is employed to be a first input end of the circuit containing fourth look up table, and a second input end is employed to be a second input end of the circuit containing fourth look up table, and an output end is employed to be an output end of the circuit containing fourth look up table.

* * * * *